United States Patent [19]

Chesnut et al.

[11] 4,240,401

[45] Dec. 23, 1980

[54] FIREPLACE HEAT EXCHANGER

[75] Inventors: Amos E. Chesnut, Columbus; Albert J. Parrigin, Scipio, both of Ind.

[73] Assignee: Arvin Industries, Inc., Columbus, Ind.

[21] Appl. No.: 879,069

[22] Filed: Feb. 21, 1978

[51] Int. Cl.[3] ..... F24B 7/00; F23H 13/00

[52] U.S. Cl. ..... 126/121; 126/164; 237/51; D23/94

[58] Field of Search ..... 126/121, 123, 120, 126, 126/135, 136, 109, 143, 164, 104 R, 104 A, 153, 163 A, 163 R; D23/94, 96; D7/206, 267; 237/51

[56] References Cited

U.S. PATENT DOCUMENTS

| | | | |
|---|---|---|---|
| 1,365,912 | 1/1921 | Greene | 126/121 |
| 1,747,259 | 2/1930 | Pierce | 126/121 |
| 2,670,917 | 3/1954 | Hoffman | 403/108 X |
| 3,452,737 | 7/1969 | Pellegrino et al. | 126/121 |
| 3,905,351 | 9/1975 | Hatfield et al. | 126/121 |
| 3,945,369 | 3/1976 | Adams et al. | 126/164 |
| 4,008,704 | 2/1977 | Petrie | 126/131 X |
| 4,010,729 | 3/1977 | Egli | 126/121 |
| 4,018,209 | 4/1977 | Bonvicini | 126/121 |
| 4,026,263 | 5/1977 | Boyd | 126/135 X |
| 4,049,196 | 9/1977 | Bergami et al. | 126/121 X |
| 4,122,825 | 10/1978 | Slate | 126/121 |
| 4,129,113 | 12/1978 | Bergstrom | 126/121 |
| 4,170,218 | 10/1979 | Hartley | 126/121 |

FOREIGN PATENT DOCUMENTS

| | | | |
|---|---|---|---|
| 556543 | 10/1943 | United Kingdom | 126/121 |
| 1169587 | 11/1969 | United Kingdom | 126/121 |

*Primary Examiner*—Samuel Scott
*Assistant Examiner*—Randall L. Green
*Attorney, Agent, or Firm*—Jenkins, Coffey, Hyland, Badger & Conard

[57] ABSTRACT

A fireplace heat exchanger grate comprising an inlet manifold, an outlet manifold and a plurality of heat exchanger tubes or pipes providing communication between the inlet and outlet manifolds. First and second duct sections are in open communication respectively with the inlet and outlet manifolds. A low-profile connector duct section extends across the front of the fireplace in open communication with both the first and second duct sections. The connector duct section includes an internal baffle between its connections to the first and second duct sections. A blower is connected to a first end of the connector duct section. Flow from the blower is directed by the baffle into the first duct section, through the inlet manifold, the heat exchanger tubes and the outlet manifold to the second duct section and outwardly through exhaust vents in the connector duct section on the downstream side of the internal baffle. The connections between the inlet manifold and the first duct section and between the outlet manifold and second duct section are telescopic to permit the heat exchanger to be adjusted to accommodate varying depths of fireplaces. The first and second duct sections are removably attached to the connector duct section so that the connector duct section can be positioned in either of two relative orientations in front of the fireplace and the blower is designed to permit it to be positioned in either of two relative orientations.

13 Claims, 4 Drawing Figures

FIREPLACE HEAT EXCHANGER

This invention relates generally to fireplaces, and specifically to a combination fireplace grate and heat exchanger which supplements and improves the heating characteristics of a conventional fireplace.

A conventional fireplace is a relatively inefficient means of heating a room. Although heat generated in the fireplace is radiated into the room, much of the heat generated in the fireplace is exhausted from the fireplace through the flue and chimney. Additionally, a substantial portion of the heated air within the room is drawn into the fireplace and exhausted through the fireplace flue and chimney.

Many structures for improving the heating characteristics of fireplaces are known. Various structures appear in the following U.S. Pat. Nos.: 1,568,816; 1,571,741; 3,190,282; 3,240,206; 3,635,211; 3,756,218; 3,866,595; 3,896,785; 3,901,212; 3,905,351; 3,930,490; 3,930,491; 3,938,496; 3,942,509; 3,945,369; 3,955,553; 3,965,886; 3,995,611; 4,008,703; 4,008,704; 4,008,706; 4,008,707; 4,010,729; 4,018,208; 4,018,209; 4,018,210; 4,049,196; 4,050,441.

It is an object of the present invention to provide an improved fireplace heat exchanger structure.

According to the present invention, a fireplace heat exchanger grate comprises an inlet manifold, an outlet manifold and a plurality of heat exchange conduits providing communication between the inlet and outlet manifolds. The heat exchanger further includes a first duct section telescopically connected to the inlet manifold and in open communication therewith, and a second duct section telescopically connected to the outlet manifold and in open communication therewith. An elongated connector duct section is provided which extends generally horizontally across the open front of the fireplace. The connector duct section is in open communication with both the first and second duct sections. The connector duct section is provided with an internal baffle between its connections to the first and second duct sections. A blower is connected to the connector duct section at a first end thereof to move air through the first end, the first duct section, the inlet manifold, the heat exchange conduits, the outlet manifold, and the secnd duct section, and to the downstream side of the baffle in the connector duct section. An outlet vent is provided in the downstream side of the connector duct section to exhaust warmed air into the room.

The telescopic connections of the first duct section to the inlet manifold and the second duct section to the outlet manifold permit adjustment to be made of the distance between the connector duct section and the grate to accommodate fireplaces having varying depths. The connector duct section is removably attached to the first and second duct sections to permit placement of the first end of the connector duct section on either the right- or left-hand side of the fireplace opening. Also for this reason, the blower is removably attached to the first end, and the blower housing is designed to permit the blower housing to be positioned in either of two orientations relative to the connector duct section.

The invention may best be understood by referring to the following description and accompanying drawings which illustrate the invention. In the drawings.

Figure 1:
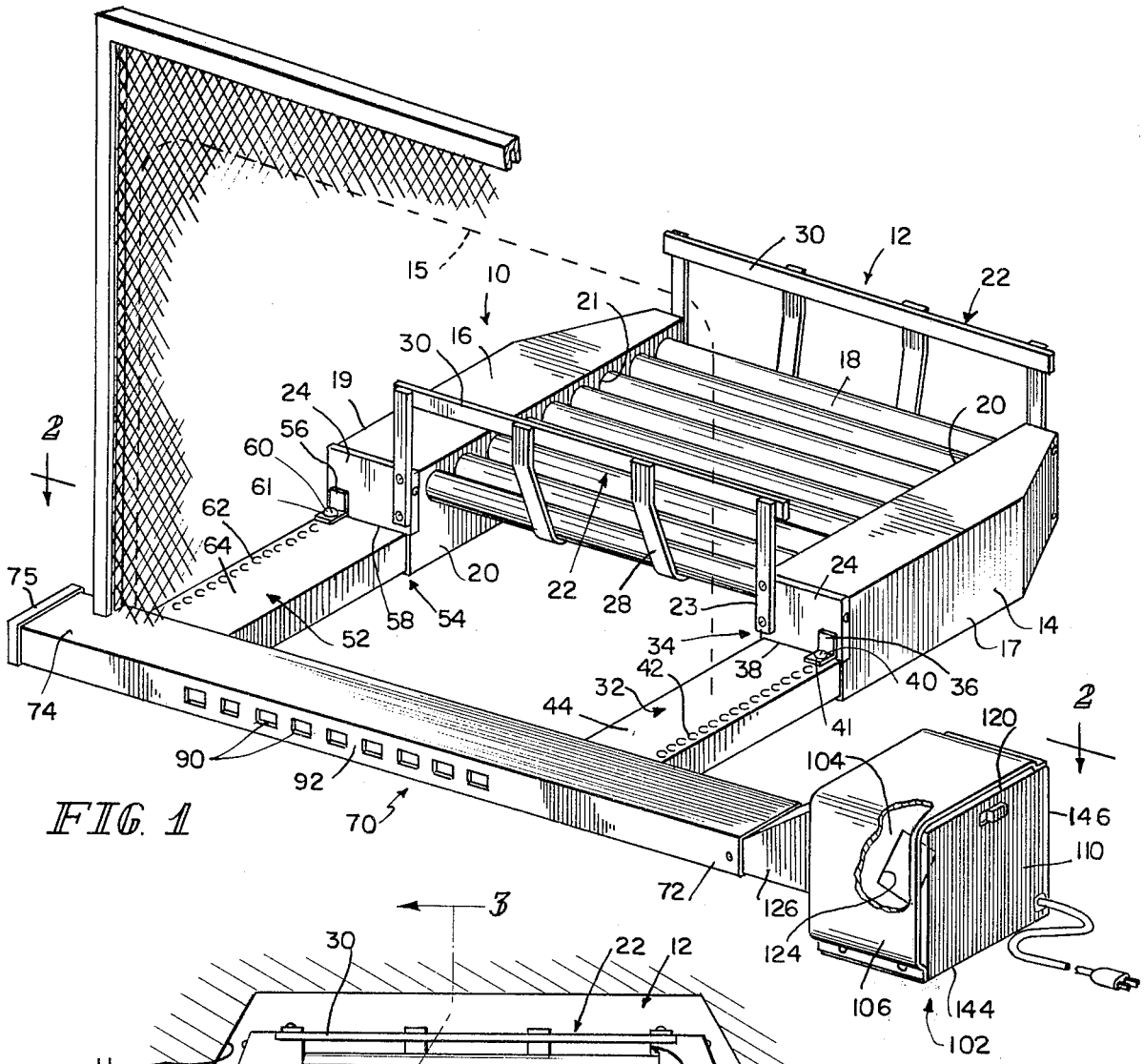
FIG. 1 is an isometric view of a fireplace heat exchanger constructed according to the present invention, a fireplace screen being shown fragmentarily, a fireplace opening being illustrated in broken lines in connection therewith.
Figure 2:
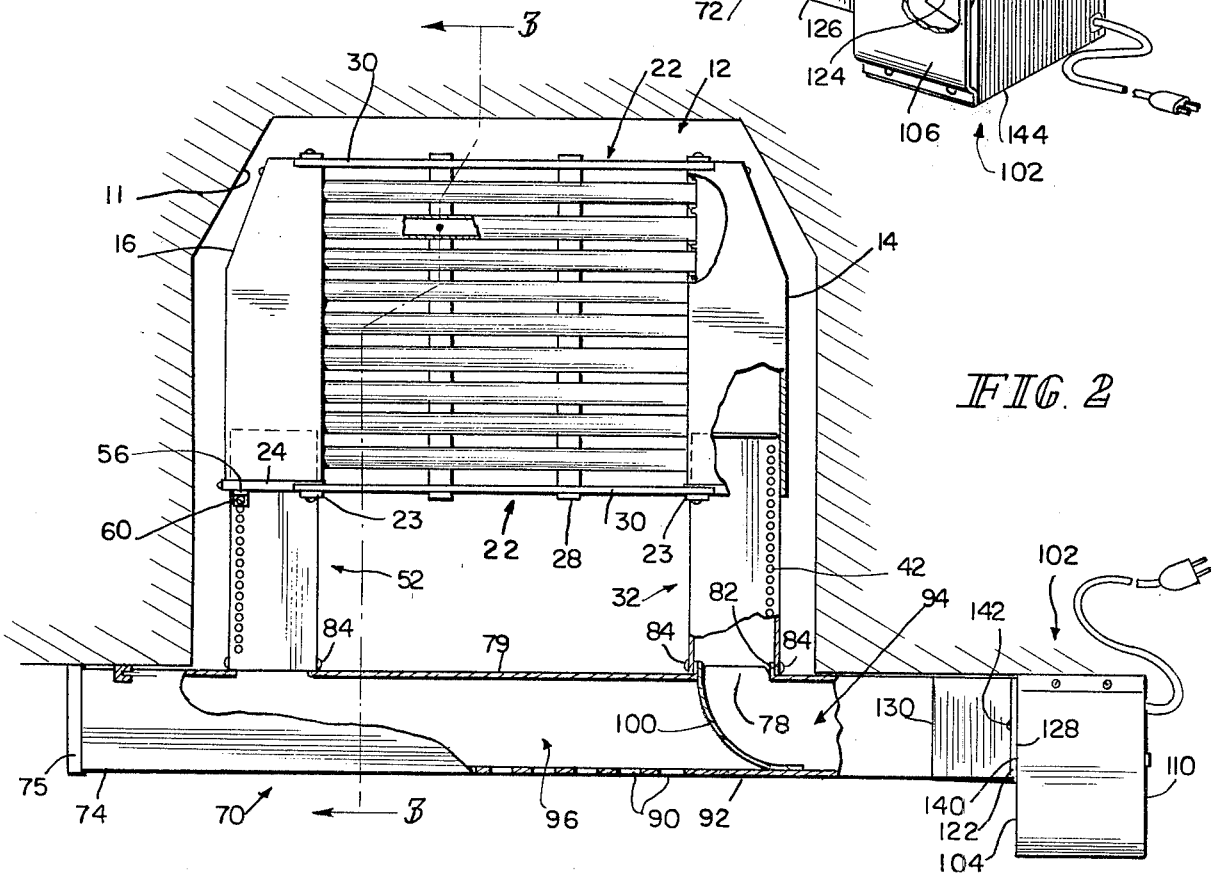
FIG. 2 is a horizontal sectional view, partly broken away, of the fireplace heat exchanger of FIG. 1, taken generally along section lines 2—2 thereof.
Figure 3:
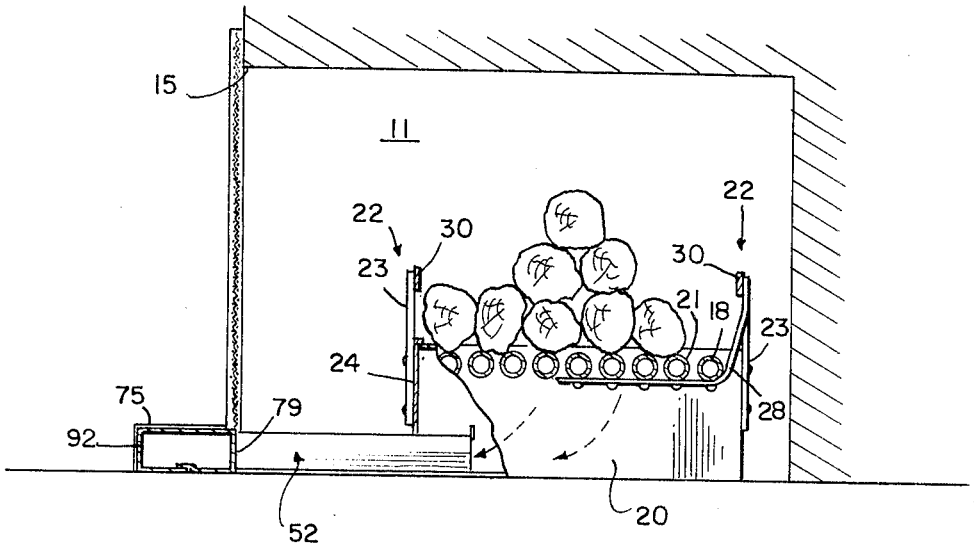
FIG. 3 is a sectional view, partly broken away, of the fireplace heat exchanger structure of FIGS. 1–2, taken generally along section lines 3—3 of FIG. 2.

Referring now to FIGS. 1–3, the apparatus 10 includes a grate 12, for insertion into a fireplace 11 through a fireplace opening 15. The grate is provided by an inlet manifold 14 and an outlet manifold 16 coupled together by a plurality of heat exchange conduits 18. Each of inlet and outlet manifolds 14, 16 is generally pentagonal prism-shaped including an outwardly and rearwardly facing wall 17, 19, respectively, to conform to the conventional shape of a fireplace. Each of inlet and outlet manifolds 14, 16 is provided with an inwardly facing wall 20 having a plurality of horizontally spaced openings 21, best illustrated in FIGS. 2–3. The heat exchange conduits 18, which are illustratively tubes or pipes, extend between inlet and outlet manifolds 14, 16, respectively, and are in open communication with the interiors of manifolds 14, 16 through openings 21. The ends of conduits 18 are secured in openings 21 by any suitable means, e.g., welding.

Grate 12 further includes a member 22 having vertical end standards 23 attached, illustratively by sheet metal screws, to the front faces 24 of inlet and outlet manifolds 14, 16, and to the rear faces 26 of inlet and outlet manifolds 14, 16. Grate member 22 further includes two somewhat U-shaped members 28 which extend beneath the heat exchange conduits 18 generally parallel to one another and are attached to the undersides of one or more of conduits 18 by any suitable means, e.g., welds or screws. Front and rear horizontal cross members 30 are provided on grate member 22, the members 30 being attached to the forward and rearward vertically upper extents of vertical standards 23 and U-shaped members 28, illustratively by welding. It will be appreciated that this somewhat "cradle" shaped grate 12 maintains the fuel in position in the fireplace 11 for burning (see FIG. 3).

The apparatus 10 further includes a first duct section 32 which is telescopically connected at 34 to the front face 24 of inlet manifold 14. The telescopic connection 34 is achieved by a bracket 36 which is welded or otherwise secured to the face 24 of inlet manifold 14 above a generally rectangular opening 38 at the bottom of face 24. Rectangular opening 38 is sized slidably to receive the generally rectangular cross section first duct section 32. A set screw 40 is provided in a threaded aperture 41 on bracket 36. A series of reliefs or indentations 42 is provided in the horizontal top wall 44 of first duct section 32. Duct section 32 is oriented in opening 38 such that one of the reliefs 42 underlies the end of set screw 40. The set screw 40 can then be tightened into the threaded aperture 41 to capture duct section 32 in a selected orientation with respect to inlet manifold 14.

A second duct section 52, which is also generally rectangular in cross section, is telescopically connected, as at 54, to the front face 24 of outlet manifold 16. This telescopic connection is achieved by bracket 56 on the wall 24 of outlet manifold 16, the bracket 56 overlying a rectangular opening 58 at the bottom of face 24 in outlet manifold 16. Opening 58 is sized slidably to receive the second duct section 52. A set screw 60 is provided in a threaded aperture 61 on bracket 56. The set screw cooperates with a series of reliefs 62 spaced along the length of top wall 64 of duct section 52 to permit the second duct section 52 to be telescoped into outlet manifold 16 to any desired position, and retained in that position by tightening of set screw 60 into one of reliefs 62.

Figure 4:
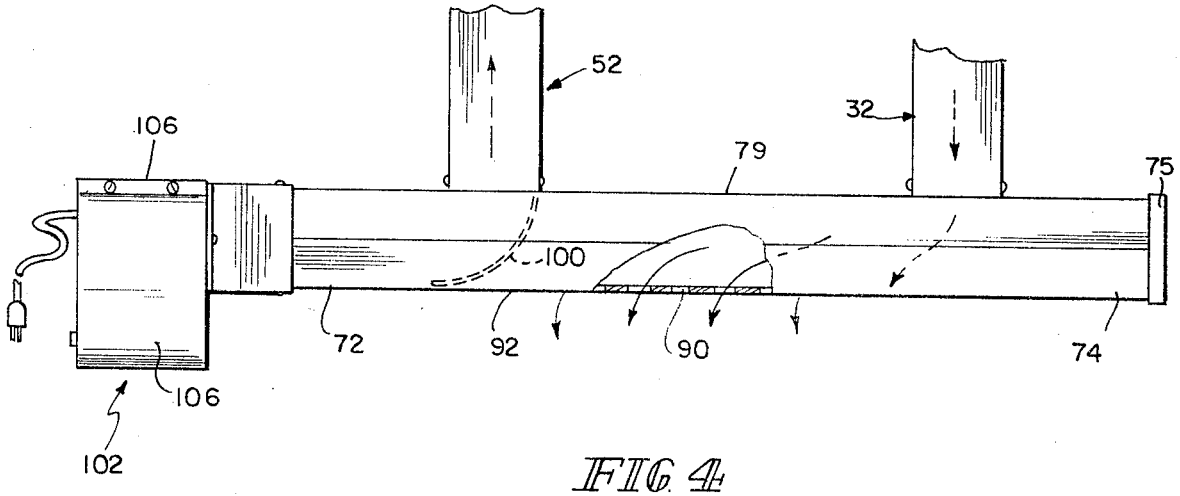
FIG. 4 is a detail, partly broken away, of an alternative arrangement of various components of the fireplace heat exchanger of FIGS. 1–3.

A generally rectangular cross-section connector duct section 70 has a first end 72 and a second end 74. The connector duct section 70 extends generally horizontally across the opening 15 of fireplace 11. The second end 74 of connector duct section 70 is closed by an end cap 75. Connector duct section 70 includes an opening 76 providing open communication with duct section 32 and an opening 78 providing open communication with duct section 52. Openings 76, 78 are formed in the generally vertically extending rearwardly facing wall 79 of duct section 70. Each of openings 76, 78 is surrounded, at least partially, by a lip 82 formed by bending part of the sheet metal around each of openings 76, 78 outwardly at right angles to wall 79. The duct sections 32, 52 are removably attached to duct section 70 by sheet metal screws 84 threaded through mated holes in the forward ends of duct sections 32, 52 and lips 82. The removable connection of duct section 70 to duct sections 32, 52 permits connector duct section 70 to be positioned in two relative orientations with respect to duct sections 32, 52 and the grate 12. That is, duct section 70 may be positioned with its first end 72 on either the right-hand side of fireplace opening 15 (as illustrated in FIGS. 1–3), or on the left-hand side of fireplace opening 15 (as illustrated in FIG. 4). Outlet or exhaust vents 90 are provided in the front vertical side wall 92 of connector duct section 70. Internally, connector duct section 70 is divided into an upstream portion 94 and a downstream portion 96 by an internal baffle 100. The baffle 100 is secured in connector duct section 70 by any suitable means, e.g., welding and prevents direct communication from the upstream side 94 to the downstream side 96. As best illustrated in FIG. 2, baffle 100 is curved to promote air flow from the first end 72 through opening 76 and into the first duct section 32. Air then circulates through the inlet manifold 14, the heat exchange conduits 18, the outlet manifold 16 and second duct section 52 to the downstream side 96 of connector duct section 70 from which it is exhausted through the outlet vents 90. It will be appreciated that when fuel is burning in the fireplace 11, the circulating air will be heated and will be exhausted through vents 90 into the room to provide additional heat.

To promote this additional heating, a blower 102 is removably attached to end 72 of connector duct section 70. Blower 102 includes a housing 104 formed from two substantially identical right angle sections 106, each of which provides two adjacent sides 107 of housing 104. The two right angle sections 106, which desirably are constructed from sheet metal, are fastened together at their diagonally opposite corners to form a sturdy cube structure. One of the remaining faces of the structure is closed by a sheet metal back 110 with openings 112, 114 for a power cord 116 and a control switch 118, respectively. Space 120 is provided between the back 110 and one of the right angle members 106 to permit air to enter housing 104. Housing 104 also includes a front face 122 closing the side thereof opposite back 110. Front face 122 is generally rectangular and is provided with a single opening 124 (illustrated in broken lines in FIG. 1) adjacent one corner thereof. The opening 124 is rectangular, but the sides of opening 124 make approximately 45° angles with the edges of front face 122. Thus, opening 124 has a somewhat diamond-shaped appearance when housing 104 is resting on one of the sides 107 thereof.

A sheet metal transition duct section 126 connects housing 104 to end 72 of connector duct section 70. As best illustrated in FIG. 1, transition duct section 126 is generally trapezoidal in longitudinal section, and has a first end 128 at which it is connected to housing 104. End 128 is generally square in cross section. Duct section 126 has a second end 130, at which it is connected to end 72 of connector duct section 70. End 130 has a rectangular cross section slightly smaller than end 72 to fit into end 72. Each side of end 128 has a length slightly greater than the diagonal dimension of opening 124 in housing 104, so that opening 124 will be entirely covered by transition duct section 126. A flange 140 is provided on end 128 and a sheet metal screw 142 is threaded through holes in flange 140 and front face 122 of housing 104 to attach the transition duct section 126 to housing 104. Two screw holes are provided in the front face 122 for the sheet metal screw 142, one for each orientation of the transition duct section 126 with respect to front face 122. In one orientation, illustrated in FIGS. 1–3, housing 104 rests on a side 144 thereof. In the other orientation, illustrated in FIG. 4, housing 104 rests on a side 146 thereof. Sheet metal screws 150 are provided for attaching the other end of transition duct section 126 to end 72 of connector duct section 70.

The connector duct section 70 has a low profile and is arranged at the bottom of the fireplace opening 15 to minimize its interference with the fireplace draft characteristics. Further, the top surface of duct section 70 is flat so that a fireplace screen may rest on top of it. This makes installation of the instant heat exchanger system simpler than many prior art systems, since the screen does not have to be altered to install this system. Alternatively, the heat exchanger system of this invention can be incorporated into one of the popular glass-and-metal fireplace screen closure structures.

What is claimed is:

1. A fireplace heat exchanger comprising an inlet manifold, an outlet manifold and heat exchange conduit means for providing communication therebetween, the inlet manifold, outlet manifold, and heat exchange conduit means together comprising a grate, a first duct section providing communication with the inlet manifold, the first duct section being selectively telescopically connected to the inlet manifold, a second duct section providing communication with the outlet manifold, the second duct section being selectively telescopically connected to the outlet manifold, means for adjustably positioning and holding the first and second duct sections in selected telescoped orientations relative to the inlet and outlet manifolds, respectively, a blower, and a connector duct section for providing communication between the blower and first duct section, and for providing an outlet vent for heated air and for providing communication between the second duct section and the outlet vent, the connector duct section extending generally horizontally across the front of the fireplace and having first and second ends, the first duct section being connected to the connector duct section adjacent the first end and the second duct section being connected to the connector duct section adjacent the second end, the connector duct section further including an internal baffle between the outlet vent and the first end for directing air from the first end through the first duct section, the grate, and the second duct section before being exhausted through the outlet vent.

2. A fireplace heat exchanger comprising an inlet manifold, an outlet manifold and heat exchange conduit means for providing communication therebetween, the inlet manifold, outlet manifold, and heat exchange conduit means together comprising a fireplace grate, a first duct section providing communication with the inlet manifold, a second duct section providing communication with the outlet manifold, each duct section telescopically engaging a respective one of the inlet and outlet manifolds, means for adjustably positioning and holding the first and second duct sections in selected telescoped orientations, a blower, and a connector duct section for providing communication between the blower and first duct section, and for providing an outlet vent for heated air and for providing communication between the second duct section and the outlet vent, the connector duct section extending generally horizontally across the front of the fireplace and having first and second ends, the first duct section being connected to the connector duct section adjacent the first end and the second duct section being connected to the connector duct section adjacent the second end, the connector duct section further including an internal baffle between the outlet vent and the first end for directing air from the first end through the first duct section, the grate, and the second duct section before being exhausted through the outlet vent, the connector duct section being shaped to permit it to be inverted and also being removably connected to the first and second duct sections to permit the connector duct section to be attached to the first and second duct sections in at least two different relative orientations.

3. The apparatus of claim 2 wherein the duct positioning and holding means comprises a bracket on each of the inlet and outlet manifolds, each bracket adjustably supporting a set screw, each of the first and second duct sections including a surface adjacent a respective set screw, each said surface including a plurality of reliefs, each relief engageable by one of the set screws to retain the first and second duct sections in their selected orientations.

4. A fireplace heat exchanger comprising an inlet manifold, an outlet manifold and heat exchange conduit means for providing communication therebetween, the inlet manifold, outlet manifold and heat exchange conduit means together comprising a fireplace grate, a connector duct section in open communication with the inlet and outlet manifolds, the connector duct section extending across the front of the fireplace, and a blower for blowing air through the grate, the connector duct section further including an outlet vent for heated air and an internal baffle dividing the connector duct section into an upstream portion and a downstream portion, the outlet vent being provided in the downstream portion, a first duct section providing open communication between the inlet manifold and the upstream portion, a second duct section providing open communication between the outlet manifold and the downstream portion, and means for telescopically coupling the first and second duct sections respectively to the inlet and outlet manifolds, the coupling means including a bracket on each of the inlet and outlet manifolds, each bracket adjustably supporting a set screw, each of the first and second duct sections including a surface adjacent a respective set screw, each said surface including a plurality of reliefs, each relief engageable by one of the set screws to retain the first and second duct sections in selected telescoped orientations.

5. A fireplace heat exchanger comprising an inlet manifold, an outlet manifold and a plurality of heat exchange conduits for providing communication therebetween, the inlet manifold, outlet manifold and heat exchange conduits together comprising a fireplace grate, an elongated connector duct section including an internal baffle dividing said connector duct section into upstream and downstream portions, a first duct section for telescopically coupling the upstream portion of the connector duct section to the inlet manifold, a second duct section for telescopically connecting the downstream portion of the connector duct section to the outlet manifold, and a blower for inducing air flow into the connector duct section, through the first duct section, the inlet manifold, the heat exchange conduits, the outlet manifold, and the second duct section, the warmed air returning to the connector duct section, the connector duct section including means defining an exhaust vent for the warmed air, and means for removably attaching the connector duct section to the first and second duct sections, the connector duct section having first and second ends, a back side facing the fireplace opening and a front side facing away from the fireplace opening, and two sides connecting the front and back sides, means for connecting the blower to one end of the connector duct section in at least two relative orientations, connection of the connector duct section to the first and second duct sections in one orientation permitting the connector duct section to rest on one of the connecting sides and the blower to be positioned in a first relationship to the grate, and connection of the connector duct section to the first and second duct sections in another orientation permitting the connector duct section to rest on the other of the connecting sides and the blower to be positioned in a second relationship to the grate.

6. The apparatus of claim 5 wherein the connector duct section rests upon the floor, both of said connecting sides permitting placement of a fireplace screen or door on top of the connector duct section.

7. The apparatus of claim 5 wherein the means for connecting the blower to one end of the connector duct section includes a transition duct section for connecting the blower to one end of the connector duct section.

8. The apparatus of claim 7 wherein the blower includes a generally rectangular prism-shaped housing providing two adjacent sides upon which the blower can be selectively placed and a third side providing an opening.

9. The apparatus of claim 8 wherein the blower opening is positioned generally in a corner of said third side, adjacent the intersection of said two sides.

10. The apparatus of claim 9 in which said transition duct section includes a first end for attachment to the blower housing third side to cover the opening and receive and direct air from the opening, and a second end having a transverse sectional shape and size to engage the first end of the connector duct section.

11. The apparatus of claim 10 in which the transition duct section has a longitudinal section which is generally trapezoidal.

12. A fireplace heat exchanger comprising an inlet manifold, an outlet manifold and a plurality of heat exchange conduits for providing communication therebetween, the inlet manifold, outlet manifold, and heat exchange conduits together comprising a fireplace grate, an elongated connector duct section including an internal baffle dividing said connector duct section into upstream and downstream portions, a first duct section for telescopically coupling the upstream portion of the connector duct section to the inlet manifold, a second duct section for telescopically connecting the downstream portion of the connector duct section to the outlet manifold, means for variably positioning and holding the first and second duct sections in selected telescoped orientations relative to the inlet and outlet manifolds, respectively, and a blower for inducing air flow into the connector duct section, through the first duct section, the inlet manifold, the heat exchange conduits, the outlet manifold, and the second duct section, the warmed air returning to the connector duct section, the connector duct section including means defining an exhaust vent for the warmed air, and means for removably attaching the connector duct section to the first and second duct sections, the connector duct section having first and secnd ends, a back side facing the fireplace opening and a front side facing away from the fireplace opening, and two sides connecting the front and back sides, means for connecting the blower to one end of the connector duct section in at least two relative orientations, connection of the connector duct section to the first and second duct sections in one orientation permitting the connector duct section to rest on one of the connecting sides and the blower to be positioned in a first relationship to the grate, and connection of the connector duct section to the first and second duct sections in another orientation permitting the connector duct to rest on the other of the connecting sides and the blower to be positioned in a second relationship to the grate.

13. The apparatus of claim 12 wherein the duct positioning and holding means comprises a bracket on each of the inlet and outlet manifolds, each bracket adjustably supporting a set screw, each of the first and second duct sections including a surface adjacent a respective set screw, each said surface including a plurality of reliefs, each relief engageable by one of the set screws to retain the first and second duct sections in their selected telescoped orientations.

* * * * *